United States Patent [19]

Pressly, Jr.

[11] 3,971,006

[45] July 20, 1976

[54] MULTI DIRECTIONAL MOTION AND VIBRATION TRIGGERING DEVICE

[76] Inventor: Palmer W. Pressly, Jr., 111 N. Burlingame Ave., Temple Terrace, Fla. 33617

[22] Filed: June 24, 1975

[21] Appl. No.: 590,011

[52] U.S. Cl. ..... 340/224; 340/274 R; 340/276; 200/61.52

[51] Int. Cl.[2] ..... G08B 13/08

[58] Field of Search ..... 340/52 H, 63, 65, 66, 340/71, 87, 224, 274 R, 276; 200/61.45 R, 61.52

[56] References Cited

UNITED STATES PATENTS

| | | | |
|---|---|---|---|
| 2,754,497 | 7/1956 | Wolpert | 200/61.52 X |
| 2,891,235 | 6/1959 | Halpert | 340/87 |
| 3,831,163 | 8/1974 | Byers | 200/61.45 R X |

*Primary Examiner*—Alvin H. Waring
*Attorney, Agent, or Firm*—Cushman, Darby and Cushman

[57] ABSTRACT

A motion detector and unique switch forming a part thereof in which the switch includes a glass housing with a spherically shaped, concave surface in which a pool of mercury rests and a pair of separated annular contacts extending in parallel planes above the mercury when the parallel planes are horizontal and electrically connected together by the mercury when the planes are tilted to a predetermined angle to the horizontal. The switch is fixedly mounted in a base which also contains electronic components for transmitting to a central receiver and the case can be pivotably attached to a glass pane or the like for movement about an axis, which does not coincide with its center of gravity, by a base having adhesive on a planer surface with a threaded stud extending through the case to engage a wing nut.

6 Claims, 5 Drawing Figures

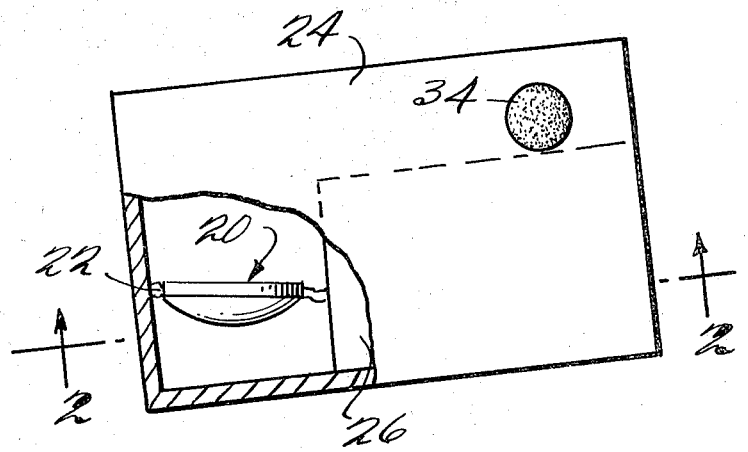
Fig. 1
Fig. 3
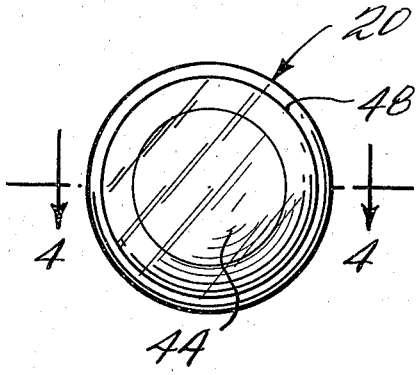
Fig. 4
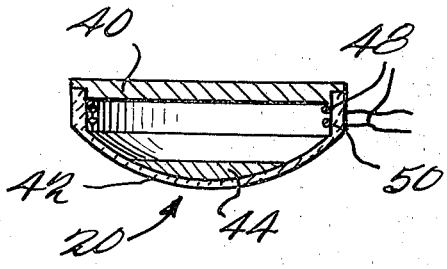
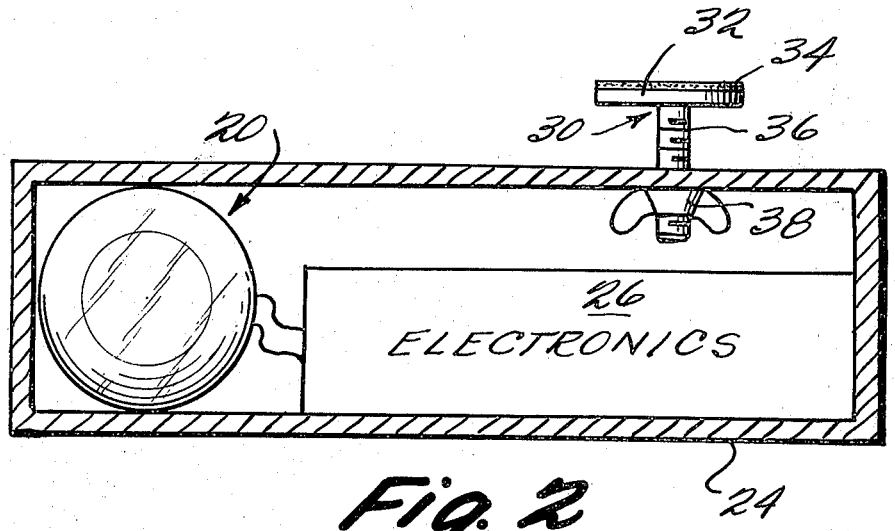
Fig. 2

MULTI DIRECTIONAL MOTION AND VIBRATION TRIGGERING DEVICE

BRIEF DESCRIPTION OF THE PRIOR ART AND SUMMARY OF THE INVENTION

The invention relates to a motion detector and switch for producing a signal in response to detected motion, for example to provide a security signal indicating intrusion.

The soaring crime rate in America today has brought to the attention of the public in general, and the home owner in particular, the dire need for security protection of business, home and family. Accordingly, in recent years there have been many systems developed and patented which include sensors which detect intrusion into a protected area or some other act and respond by producing an audio alarm or taking other appropriate action. In general, these systems have been relatively expensive and difficult to install. Many different types of sensors are required to protect the different areas of the home or like through which illegal intrusion may occur, for example doors, windows, etc. The complexity and difficulty of installation of such systems in the past has lead to a high level of false alarms, reducing the effectiveness and credibility of the system.

The present invention relates to a simple, rugged and effective motion detector and switch which can be utilized in a security system, preferably in a wireless system. Installation time is minimal and no previous knowledge or experience is required to make an easy and proper installation. The invention can be used in and as a part of any conventional radio frequency transmitter now on the market with very simple modifications. Even further, the motion detector of this invention can be used in a number of different situations which in the past have required totally different types of sensors. The detector can be mounted on almost all types of window openings-sash, awning, and jalousie as well as stationary glass openings. It can also be mounted on screens or frames to provide excellent protection. The near universality of this detector results in considerable cost savings to the user.

The detector of this invention includes a motion detector switch which is fixedly mounted within a conventional casing of the type now used to house typical electrical transmitters. The switch preferably includes a pool of mercury which closes a pair of electrical contacts when the casing has been shifted to a predetermined orientation. The casing can be attached, for example to a window pane, by means of a base having a planar surface with an adhesive backing which can be easily attached to the pane and a stud which extends through a hole in the casing back to be held in place by a wing nut or the like. The hole through which the stud extends does not coincide with the center of gravity of the transmitter, but rather is off center so that one edge of the base can rest on a sill or the like and the relative movement between the pane and sill which inevitably results during intrusion causes the casing to pivot further and the switch fixed in the casing to shift into an orientation such as to produce an electrical alarm signal. Alternatively, the device can be easily mounted on a screen covering the opening to provide the same type of protection.

The second major category of openings that this type of device protects is an awning window where the pane pivots about a horizontal axis. The device can be simply fixed to the glass by tightening the wing nut so that pivotable movement of the glass triggers the motion signal.

Another major application of this device is for use as a vibration sensor. In this application the unit can be mounted fixedly to a glass or the like with the tension of the wing nut being adjusted so that the transmitter will pivot about its off center axis to sound the alarm whenever vibrations greater than a predetermined sensitivity are produced, for example by breakage of a window or a severe rattling thereof.

The unique sensor of this application is comprised of a switch housing enclosing a quantity of mercury which pools in a spherically shaped, concave lower surface or dish. The housing is preferably formed of an insulating material, for example glass. A pair of annular wires or contacts extend about the cylindrical side walls of the housing above the mercury pool so that when the switch is in a horizontal orientation the pool of mercury does not electrically connect together the two contacts. However, when the switch is slightly tilted, for example 5° to 10°, the mercury flows by gravity into a position electrically connecting together the two annular contacts or wires and producing a signal indicating intrusion.

Numerous prior art structures including the systems described in U.S. Pat. Nos. 3,696,359; 3,778,803; 3,500,376; and 3,701,371, show arrangements in which relative movement of elements with respect to each other in a mercury switch provide a unique signal. However, none of these prior systems has the universality of application of this particular motion detector nor do any combine the simplicity of operation and reliability which is inherent in the unique invention of this application.

Many other objects and purposes of the invention will be clear from the following description of the drawings.

BRIEF DESCRIPTION OF THE DRAWINGS

FIG. 1 shows a partially cut away view of the unique motion detector of this invention.

FIG. 2 shows a sectional view of the detector of FIG. 1 along the lines 2—2.

FIG. 3 shows a top view of the unique switch of this invention.

FIG. 4 shows a sectional view of the switch of FIG. 3 along the lines 4—4.

DETAILED DESCRIPTION OF THE DRAWINGS

Figure 5:
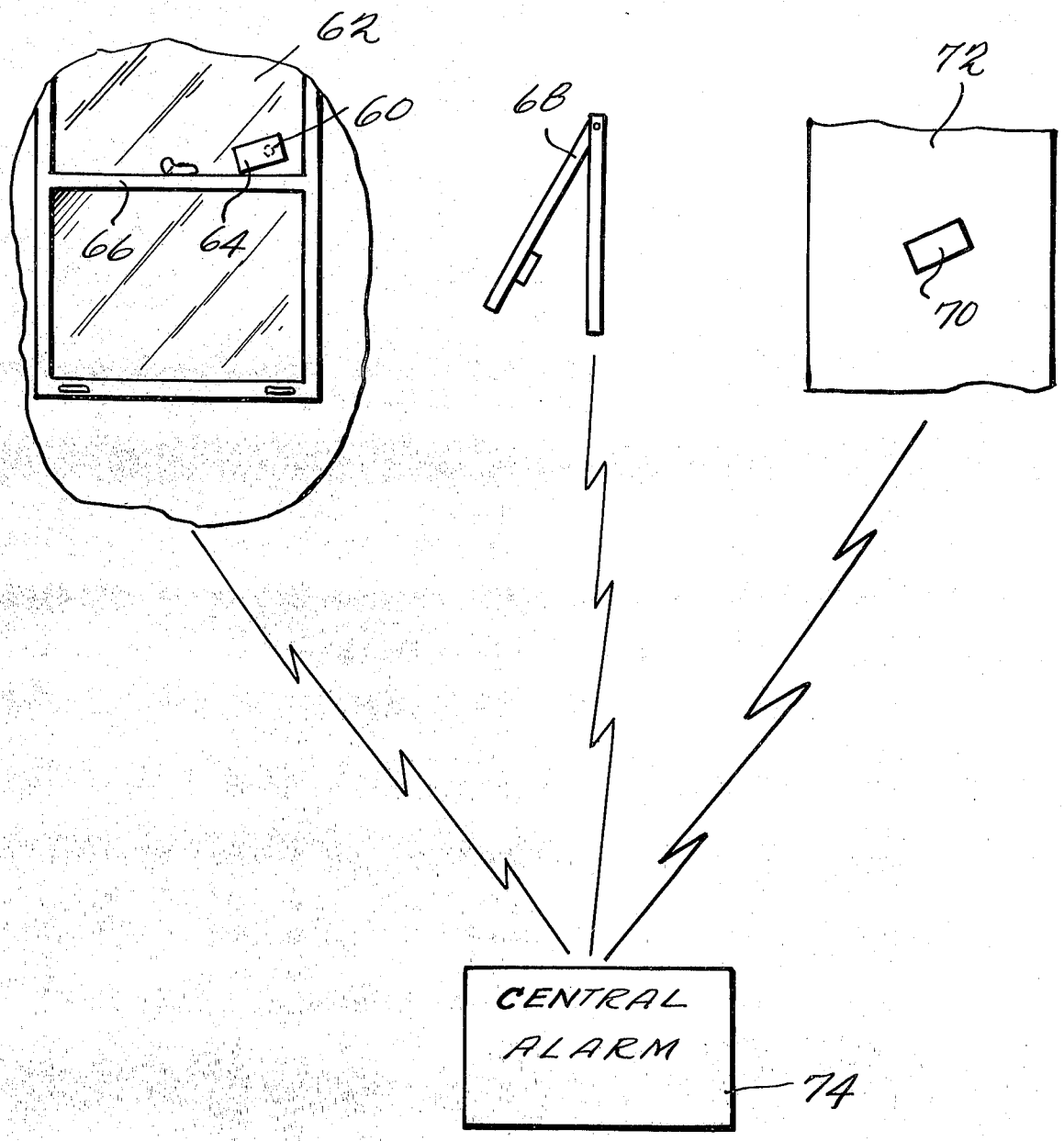
FIG. 5 shows a number of detectors of this invention coupled together into an operative security system.

Reference is now made to FIGS. 1 and 2 which illustrate the motion detector of this invention. The detector includes a switch 20 which is detailed in FIGS. 3 and 4 and which produces an electrical output signal when switch 20 determines that motion has been detected and particularly when switch 20 has been shifted into a predetermined orientation and into a position having a predetermined angle with regard to the horizontal.

Switch 20 is mounted on a bracket 22, or by any other suitable means, fixedly within a hollow housing or casing 24 which may be formed of metal, plastic or otherwise. Many such transmitter housings enclosing transmitter electronics are available in the market place and most such units may be simply modified by mounting a sensor of this invention therein and adding a pivotable mounting.

As discussed below the two annular contacts in switch 22 extends in parallel planes, and these parallel planes form an angle with regard to the planes of each of the surfaces of housing 24. Accordingly when casing 24 is mounted as illustrated, switch 20 and particularly the annular contacts thereof extend in a horizontal plane. Switch 20 is connected to conventional electronics 26 of the transmitter, which are illustrated schematically in FIG. 2, and which produce a radio frequency signal for transmission to a central station.

Hollow casing 24 is pivotably connected to an area to be protected, for example a pane of glass or the like, by a base 30 having a planar surface 32 with an adhesive backing 34 thereon which will stick to a pane of glass or the like. Base 30 further includes a threaded stud 36 which extends through an aperture in casing 24 and which engages a wing nut 38 or the like within casing 24. The tension of wing nut 38 can be manually adjusted in order to permit easy pivoting of the casing 24 about its axis of rotation, which does not coincide with its center of gravity, or to permit pivoting only if vibrations above a certain intensity are applied to casing 24.

Referring now to FIGS. 3 and 4, switch 20 includes a closed housing 40 with a lower spherically shaped, concave surface 42 on which rests a pool of mercury 44. A pair of annular electrical contacts extend about the cylindrical surface 46 of housing 40 above the level of pool 44 so that when the planes of the two annular wires 48 and 50 are horizontal the two wires are not connected together by mercury pool 44. However, when switch 20 is shifted into an orientation at a predetermined angle to the horizontal, pool 44 moves by gravity into a position electrically connecting together wires 48 and 50 producing a signal indicating that motion has taken place.

The unique switch illustrated in FIGS. 3 and 4 permits the sensor to protect against motion in the entire horizontal plane. Accordingly, the transmitter can be mounted both on an awning type window which pivots about a horizontal axis or about a sash window which moves vertically with regard to a sill.

Referring now to FIG. 5, mounting of the transmitter in three separate types of applications are illustrated. Transmitter 60 is shown pivotably attached to window pane 62 with end 64 resting on the sill. Relative motion between sill 66 and pane 62 causes transmitter 60 to freely pivot about it's axis and to shift the orientation of the unique switch of this invention therein to produce a motion signal. Similarly, transmitter 66 produces a signal when the pane 68 is swung outwards about a horizontal axis. Finally, motion detector 70 is mounted on a fixed pane of glass or the like to detect vibrations, for example which are produced by breaking the window or severely rattling the same and to produce an electrical signal in response thereto. The vibrations cause the mercury to move upward and to at least temporarily connect together the electrical annular contacts. Production of a motion signal by any of the detectors 60, 66 or 70 produces a radio frequency signal which is transmitted to a conventional central alarm 74 which responds in conventional fashion by producing an audio alarm, telephoning the police station or taking other appropriate action.

Many changes and modifications in the above described embodiment of the invention can of course, be carried out without departing from the scope thereof. Accordingly, that scope is intended to be limited only by the scope of the appended claims.

What is claimed is:

1. A motion detector for producing a motion signal comprising:

switch means for producing said motion signal when shifted from a first to a second orientation with respect to a horizontal plane, case means defining an interior space in which said switch means is mounted in a position fixed with respect to said case means means mounted within said casing and connected to said switch means for transmitting a signal when said motion signal is produced and means for pivotably mounting said case means to a fixed planer surface about an axis which passes through said interior space but does not pass through the center of gravity of said case means so that pivotable movement of said case means shifts said case means to a position which shifts said switch means from said first to said second orientation by an external force applied to said case means so that said switch means produces said motion signal.

2. A detector as in claim 1 wherein said pivotably mounting means includes a base having a planer surface, adhesive backing fixed to said base surface for attaching said base to a window pane or the like, a threaded stud fixed to said base and extending through a hole in said case means and a nut engaging said threads within said case means.

3. A detector as in claim 2 wherein said nut is a wing nut.

4. A detector as in claim 1 wherein said switch means comprises a closed switch housing having a spherically shaped, concave surface and formed of electrically insulating material, a pool of mercury-trapped within said housing, and a pair of annular electrical contacts mounted in said housing above said concave surface and extending in roughly parallel planes so that when said parallel planes are horizontal said pool does not electrically connect said contacts but when said parallel planes are tilted to a predetermined angle to the horizontal said pool electrically connects and contacts.

5. A detector as in claim 4 wherein said housing is glass.

6. A detector as in claim 4 wherein said case means includes a hollow box having parallel sides and said parallel planes of said contacts extend at an angle to said parallel sides.

* * * * *